US006335589B2

(12) United States Patent
Oku et al.

(10) Patent No.: US 6,335,589 B2
(45) Date of Patent: Jan. 1, 2002

(54) COLOR CATHODE RAY TUBE HAVING ADJUSTMENT MAGNET ASSEMBLY AT NECK PORTION

(75) Inventors: Kentaro Oku, Mobara; Hidehiro Koumura, Gosyogawara; Tomoki Nakamura, Mobara; Hisashi Nose, Chiba; Kunio Ishiyama, Mobara, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/756,145

(22) Filed: Jan. 9, 2001

Related U.S. Application Data

(63) Continuation of application No. 09/115,941, filed on Jul. 15, 1998, now Pat. No. 6,194,823.

(30) Foreign Application Priority Data

Jul. 15, 1997 (JP) ..... 9-189762

(51) Int. Cl.[7] ..... H01J 29/50

(52) U.S. Cl. ..... 313/412; 313/431; 313/442; 335/210

(58) Field of Search ..... 313/412, 413, 313/442, 431, 426, 428, 433, 440; 335/212, 210

(56) References Cited

U.S. PATENT DOCUMENTS

| | | | | |
|---|---|---|---|---|
| 3,725,831 | A | | 4/1973 | Barbin |
| 3,772,554 | A | | 11/1973 | Hughes |
| 4,050,042 | A | | 9/1977 | Anthony |
| 4,401,917 | A | | 8/1983 | Gerritsen |
| 4,570,140 | A | | 2/1986 | Teruaki |
| 4,670,726 | A | | 6/1987 | Ogata et al. |
| 5,227,753 | A | | 7/1993 | Hirai et al. |
| 5,289,149 | A | | 2/1994 | Nishita et al. |
| 5,399,933 | A | | 3/1995 | Tsai |
| 5,572,084 | A | | 11/1996 | Uchida et al. |
| 6,069,438 | A | | 5/2000 | Okamoto |
| 6,160,343 | A | * | 12/2000 | Joung ..... 313/440 |

FOREIGN PATENT DOCUMENTS

| | | |
|---|---|---|
| EP | 0 244 908 A2 | 11/1987 |
| EP | 0 257 639 A2 | 3/1988 |
| EP | 0 421 523 A1 | 4/1991 |
| EP | 0 456 224 A2 | 11/1991 |
| GB | 2 060 993 A | 5/1981 |
| JP | 9-063511 | 3/1997 |

* cited by examiner

*Primary Examiner*—Nimeshkumar D. Patel
*Assistant Examiner*—Karabi Guharay
(74) *Attorney, Agent, or Firm*—Antonelli, Terry, Stout & Kraus, LLP

(57) ABSTRACT

A color cathode ray tube comprises a vacuum vessel including a panel portion having a phosphor screen on its inner face, a neck portion and a funnel portion joining the neck portion and the panel portion. An inline electron gun is disposed inside of the neck portion and includes a main lens and cathode producing a center electron beam and two side electron beams. A deflection yoke for deflecting the electron beams and a pair of 2-pole ring magnets for adjusting electron beam trajectory are disposed around the neck portion. The 2-pole ring magnets have a magnetic flux density distribution at a circle which is concentric with the ring magnets, wherein the radius of the circle corresponds to the distance between adjacent electron beams at the main lens. The ratio of the amplitude of the flux density in the radial component compared to the amplitude of the flux density in the circumferential component is 0.86 to 1.38 on the circle.

8 Claims, 12 Drawing Sheets

(a) $\ell_1$=5mm, $\ell_3$=8mm (a=0.552, c=0.339)

(b) $\ell_1$=5mm, $\ell_3$=12mm (a=0.828, c=0.339)

(c) $\ell_1$=5mm, $\ell_3$=16mm (a=1.103, c=0.339)

(c) $\ell_1$=5mm, $\ell_3$=20mm (a=1.379, c=0.339)

(e) $\ell_1$=8mm, $\ell_3$=20mm (a=1.103, c=0.542)

7.868 GAUSS/DIV.
R=6.00MM

COLOR CATHODE RAY TUBE HAVING ADJUSTMENT MAGNET ASSEMBLY AT NECK PORTION

CROSS REFERENCE TO RELATED APPLICATION

This is a continuation of U.S. application Ser. No. 09/115,941, filed Jul. 15, 1998, now U.S. Pat. No. 6,194,823, the subject matter of which is incorporated by reference herein.

BACKGROUND OF THE INVENTION

The present invention relates to a color cathode ray tube of the type which is equipped with an in-line type electron gun constructed to emit three electron beams horizontally in one row toward a phosphor screen.

In a color cathode ray tube, a vacuum vessel is constructed of a panel portion providing a display screen, a neck portion having an electron gun assembly disposed therein, and a funnel portion joining the panel portion and the neck portion.

In an electron gun assembly arranged in the neck portion, three electron guns are arrayed in-line at a spacing s for emitting three electron beams for individually irradiating red (R), green (G) and blue (B) color phosphors of a phosphor screen formed on the inner face of the panel portion. On the phosphor screen, there are arranged individual phosphors which are adjacent to each other for the red (R), green (G) and blue (B) colors to form one color pixel.

The three electron beams, as emitted from the individual electron guns, are able to irradiate the individual phosphors corresponding to each color pixel by the actions of a deflection yoke (hereinafter to be referred to as the "DY") which is mounted generally around the boundary between the neck portion and the funnel portion. In order to adjust the trajectories of the electron beams so that the individual electron beams, as deflected by the DY, may irradiate predetermined phosphors accurately, an adjustment magnet arrangement is mounted around the neck portion. This adjustment magnet arrangement is constructed, for example, of 2-pole and 4-pole magnets disposed on the side of the DY, and a magnet assembly composed of 2-pole, 4-pole and 6-pole magnets disposed on the side of the electron gun assembly.

As an example of a color cathode tube having the aforementioned construction, there has been proposed a color cathode ray tube which has an enhanced deflection sensitivity obtained by reducing the external diameter of the neck portion, as disclosed in Japanese Patent Laid-Open No. 7-141999 (Japanese Patent Application No. 5-286772).

SUMMARY OF THE INVENTION

However, when a color cathode ray tube is constructed in such a way as to reduce the external diameter of the neck portion to 24.3 mm (from a conventional diameter of 29.5 mm) and, accordingly, to reduce the s-size (electron beam spacing at the main lens of the electron gun assembly, hereinafter to be referred to as the "s-size") of the electron guns to 4.75 mm (from the conventional size of 5.5 mm), the relative tolerances normalized by either the s-size or the size of the external diameter of the neck portion are increased, if the electron gun and sealing tolerances have been set likewise for the large external diameter neck portion. Then, it can be operated without adjusting the shifts of the electron beams to large values.

When the shift adjustment by the 2-pole magnet of the adjustment magnet arrangement thus increases, there arises a difference among the amounts of shift of the individual electron beams of the red (R), green (G) and blue (B) colors. Thus, the 6-pole and 4-pole magnets of the magnet assembly have to act upon the individual electron beams to adjust the aforementioned difference in the amounts of shift. As a result, the electron beams are shifted at first by the 6-pole and 4 pole magnets of the magnet assembly so that their center trajectories fail to follow the axis of the main lens of the electron gun.

When the center trajectories of the electron beams follow paths shifted upward of the lens center, for example, the upper portions of the electron beams come closer to the electrode than the lower portions so that the upper portions of the beams are more focused than the lower portions. As a result, there appears a phenomenon in which the focuses of the beams are offset at the upper and lower portions. Even if the focus of the main lens is adjusted by the electrode voltage, therefore, the upper and lower portions of the electron beams cannot be simultaneously focused to an optimum degree. As a result, the outer peripheral portions (or a so-called "halo") of the electron beams are offset in shape. When this halo exceeds an allowable range, the focusing characteristics are deteriorated, thereby to degrade the display image.

When the 2-pole magnet of the magnet assembly is activated, there will also arise a difference in the amounts of shift of the individual electron beams of the red (R), green (G) and blue (B) colors. If the 2-pole magnet is placed very much closer to the 4-pole and 6-pole magnets, however, this shift difference is compensated by the adjoining 4-pole and 6-pole magnets, so that the difference in the individual amount of shift can be adjusted to reduce the misalignment of the electron beams in the main lens.

In other words, the aforementioned phenomenon, i.e. the halo offset, becomes more noticeable for the case in which the 2-pole magnet for color purity adjustment is located at a back stage, i.e., away from the 4-pole and 6-pole magnets, which are normally located at a front stage relative to the main lens.

An object of the invention is to provide a color cathode ray tube which can reduce the focusing defect of the offset halo and can improve the reliability, even if the 2-pole magnet is located away from the 4-pole and 6-pole magnets.

According to a feature of the invention, there is provided a color cathode ray tube comprising: a vacuum vessel including a panel portion having a phosphor screen on its inner face, a neck portion and a funnel portion joining the neck portion and the panel portion; an electron gun assembly including an electrostatic main lens disposed in the neck portion; a deflection yoke arranged around the neck side of the funnel portion for deflecting the three in-line arranged electron beams which are emitted from the electron gun assembly to the phosphor screen; and a 2-pole magnet arranged around the neck portion for adjusting the trajectories of the electron beams. The 2-pole magnet is arranged to have its center closer to the phosphor screen than the center of the electrostatic lens of the electron gun assembly. The value, as calculated by dividing the value of the radial component amplitude of the magnetic field distribution of the 2-pole magnet on the circumference of a circle having a radius of the e-size, by the value of the circumferential component amplitude, is 0.86 to 1.38, are preferably 0.955 to 1.275. The color cathode ray tube thus constructed according to the invention can reduce the focusing defect drastically, as might otherwise be caused by the halo effect.

BRIEF DESCRIPTION OF THE DRAWINGS

FIG. 12(*b*) is a graph plotting the distribution of a magnetic field on a circumference of a radius of 4.75 mm of the DY 2-pole magnet of the color cathode ray tube according to the embodiment of the invention;

FIG. 13(*b*) is a graph plotting the distribution of a magnetic field on a circumference of a radius of 4.75 mm of the DY 2-pole magnet of the color cathode ray tube of the prior art;

FIG. 14(*b*) is a diagram showing the distribution of a magnetic field in a (x, y) section, as spaced by 10 mm in a direction from the center of the DY 2-pole magnet of the color cathode ray tube according to the embodiment of the invention;

FIG. 15(*b*) is a diagram showing the distribution of a scholar value of a magnetic field vector at the central portion of the DY 2-pole magnet of the color cathode ray tube of the prior art;

FIG. 18(*b*) is a side elevation showing a three-dimensional magnetic field measuring apparatus.

DETAILED DESCRIPTION OF THE PREFERRED EMBODIMENTS

One embodiment of a color cathode ray tube according to the invention will be described with reference to the accompanying drawings.

Figure 2:
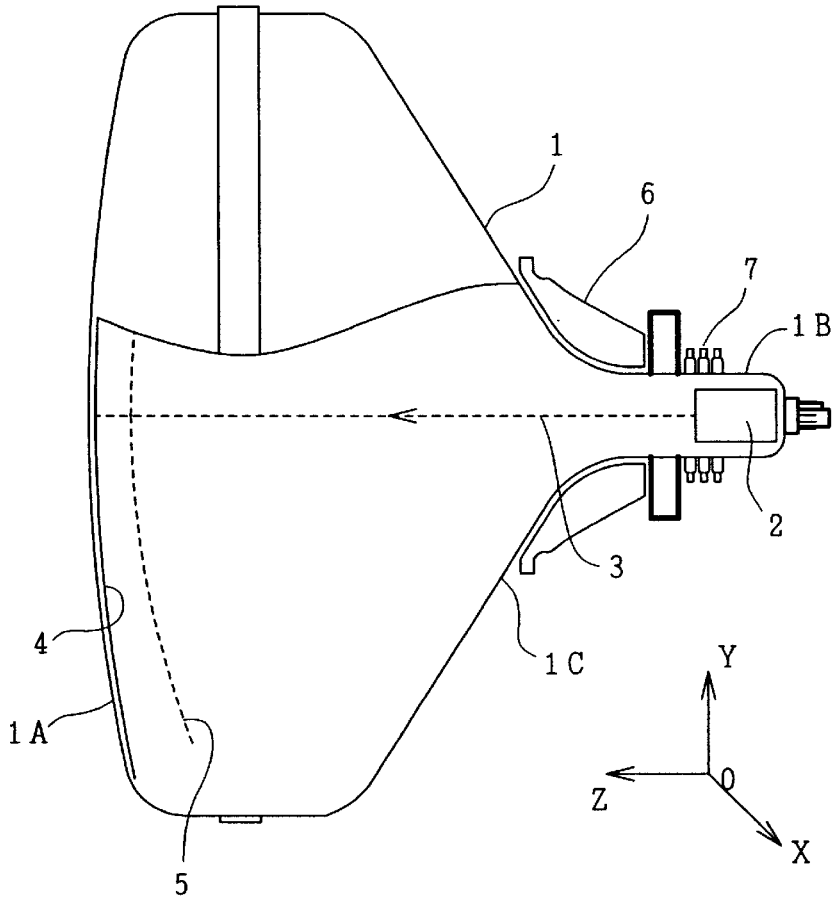
FIG. 2 is a partially broken diagrammatic view of the color cathode ray tube according to the embodiment of the invention.

FIG. 2 is a diagrammatic view partly in section showing the construction of a color cathode ray tube according to the invention. Reference numeral 1 appearing in FIG. 2 designates a vacuum vessel of a cathode ray tube. This vacuum vessel 1 is made of glass and is composed of: a panel portion 1A acting as a display portion of a color cathode ray tube; a neck portion 1B housing an electron gun assembly 2; and a funnel portion 1C connecting the panel portion 1A and the neck portion 1B smoothly.

The neck portion 1B of the color cathode ray tube of this embodiment has an external diameter smaller than 28.1 mm. In the neck portion 1B, there is arranged the electron gun assembly 2. The electron gun assembly 2 emits three in-line (arranged in an x-direction as shown in FIG. 2) electron beams 3 (although only one is shown) for radiating red (R), green (G) and blue (B) color phosphors, respectively, toward the panel portion 1A. A phosphor screen 4 is formed on the inner wall face of the panel portion 1A. In the regions, corresponding to color pixels, of the phosphor screen, there are arranged individual phosphors of red (R), green (G) and blue (B) colors adjacent to each other.

The three electron beams 3, as emitted from the electron gun assembly 2, irradiate the phosphors of red (R), green (G) and blue (B) corresponding to the individual color pixels. The color cathode ray tube of this embodiment has an effective screen size with a diagonal length of 36 to 51 cm, and the individual phosphors are arrayed at a pitch less than 0.31 mm.

The inner wall face of the panel portion 1A, on which the phosphor screen 4 is formed, is closely confronted by a shadow mask 5 acting as a color selective electrode. This shadow mask 5 has one electron beam transmitting hole for each color pixel.

The individual electron beams 3, as emitted from the electron gun assembly 2, pass a common electron beam transmitting hole on the shadow mask 5 to irradiate the individual red (R), green (G) and blue (B) color phosphors, corresponding to one color pixel.

On the funnel portion 1C of the vacuum vessel 1 on the side of the neck portion 1B, on the other hand, there is mounted a deflection yoke (DY) 6, which acts to deflect the individual electron beams 3, as emitted from the electron gun assembly 2, in the horizontal direction and in the vertical direction, thereby to scan all the pixels on the phosphor screen 4 from the upper left to the lower right, for example. Here, the color cathode ray tube of this embodiment has a deflection angle of 90 degrees, but the invention can also be applied to a color cathode ray tube having a deflection angle of 100 degrees.

On the outer side of the vacuum vessel 1 at the neck portion 1B, moreover, adjustment magnets 7 are mounted for adjusting the positions of the individual electron beams 3 of the red (R), green (G) and blue (B) colors.

Figure 3:
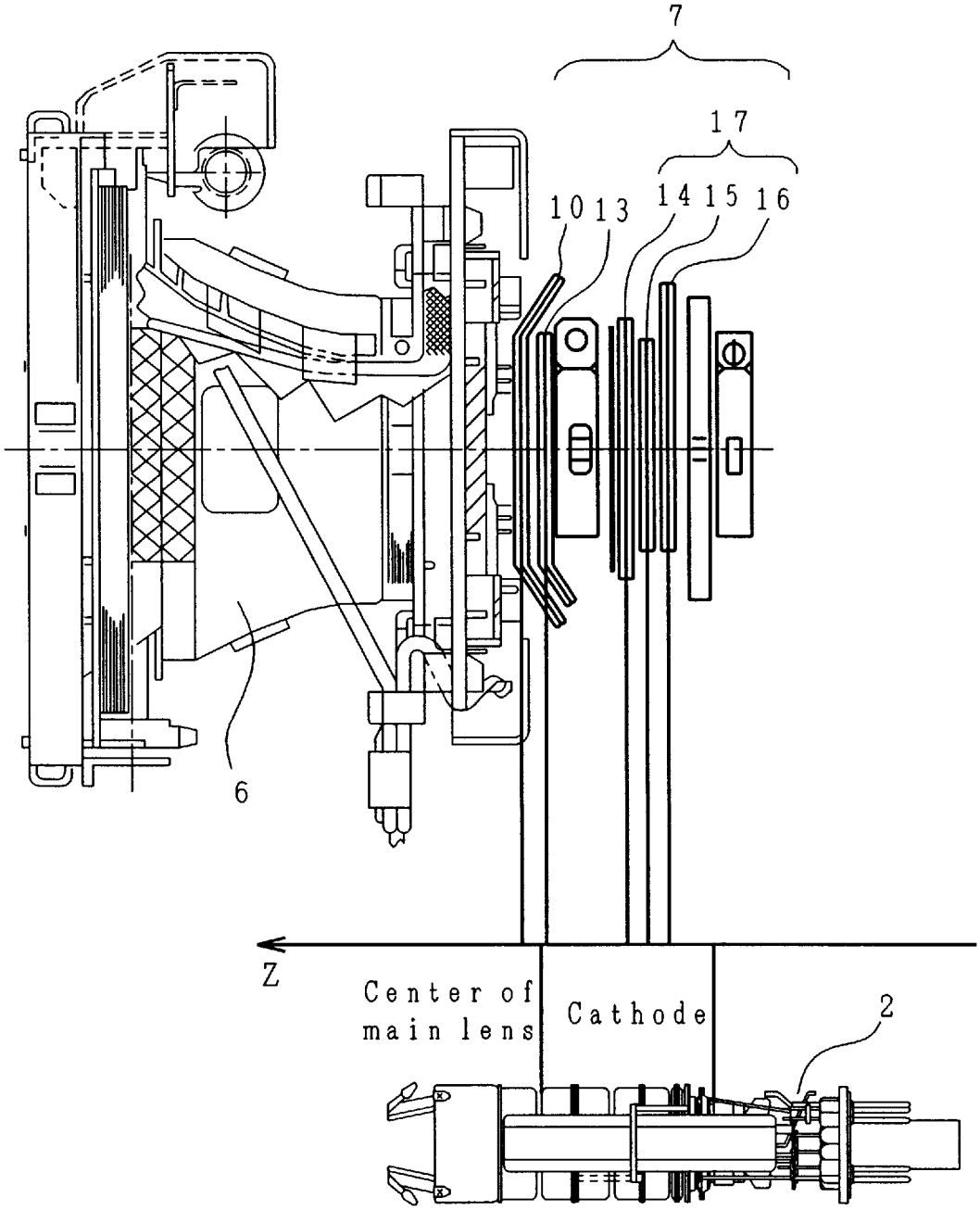
FIG. 3 is a side elevation of an electrooptical system of the color cathode ray tube according to the embodiment of the invention.

FIG. 3 is a diagram showing a detailed construction of an electro-optical portion of the color cathode ray tube of this embodiment. The electro-optical system is constructed to include: the electron gun assembly 2 equipped with a triode portion (including the cathode) for generating the electron beams and an electrostatic lens (or main lens) for converging the electron beams; the DY 6 for deflecting the electron beams; and the adjustment magnet arrangement 7 for adjusting the positions of the individual electron beams of the red (R), green (G) and blue (B) colors.

On the neck side of the DY 6, there are arranged 2-pole and 4-pole adjustment magnets (i.e., a DY 2-pole magnet 10 and a DY 4-pole magnet 13). At the back of the DY 2-pole magnet 10 and the DY 4-pole magnet 13, there is mounted a magnet assembly 17 which is composed of a 2-pole magnet 14, a 4-pole magnet 15 and a 6-pole magnet 16. Each of the DY 2-pole magnet 10, the DY 4-pole magnet 13, the 2-pole magnet 14, the 4-pole magnet 15 and the 6-pole magnet 16 is composed of two magnets.

In order that the three electron beams emitted from the three electron guns of the electron gun assembly 2 may overlap (or converge) on the screen, the electrodes of the two side red (R) and blue (B) electron guns are offset. In order to adjust this convergence from the outside, moreover, a 4-pole magnet is concentrically arranged around the neck portion 1B of the color cathode ray tube.

Due to tolerances at the time of assembling the electrodes of the electron guns and due to errors at the time of sealing the electron guns, an electron beam corresponding to each of the red (R), green (G) and blue (B) color phosphors often impinges upon the phosphors of other colors, thereby to deteriorate the color purity when the individual electron beams of the red (R), green (G) and blue (B) colors are wholly shifted. Thus, the 2-pole magnets are provided for adjusting those shifts of the three electron beams. If the electron beams of the red (R), green (G) and blue (B) colors have different shifts, the shifts are adjusted by the 4-pole and 6-pole magnets to reduce the differences.

As shown in FIG. 3, the 2-pole magnets are attached to both the magnet assembly and the DY. The 2-pole magnet 14, as attached to the magnet assembly 17, is provided for adjusting the incident position of the electron beams on the main lens to prevent an increase in aberration to be received from the main lens by the electron beams. On the other hand, the DY 2-pole magnet 10 is provided for adjusting the color purity.

For this color purity adjustment, it has been conventional to employ the 2-pole magnet 14 of the magnet assembly 17 at an upstream stage of the electron gun, but this embodiment employs the 2-pole magnet 10 of the DY at a back stage thereof. The reason for this will be explained in the following. When the electron beams are shifted by the magnet assembly 17 at the front stage of the electron gun, the incident positions of the electron beams on the main lens are seriously shifted from the center axis to generate a coma aberration. In order to eliminate this comma aberration, the 2-pole magnet 10 is employed to minimize the misalignment between the electron beams and the electron guns in the main lens, thereby to shift the electron beams as much as possible at the back stage. As shown in FIG. 3, the DY 2-pole magnet 10 has to be centered on the screen side relative to the center of the main lens. Here, the DY and the magnet assembly are individually equipped with a 4-pole magnet, but the aforementioned adjustment is made by mainly activating the 4-pole magnet 15 which is mounted as part of the magnet assembly 17.

Figure 4:
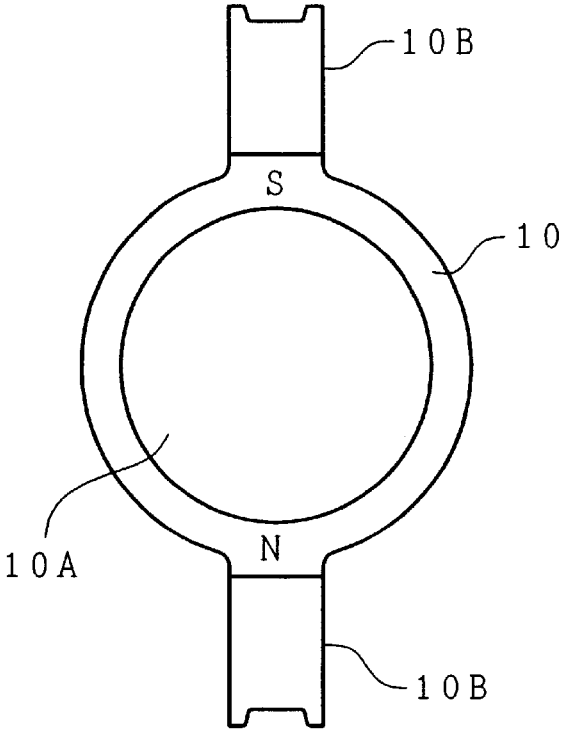
FIGS. 4(*a*) and 4(*b*) are a top plan view and a side elevation, respectively, of the DY 2-pole magnet of the color cathode ray tube according to the embodiment of the invention.
Figure 4:
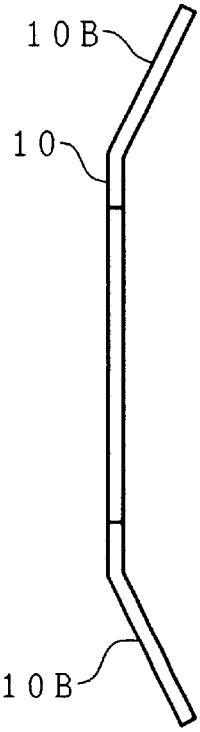

FIGS. 4(*a*) and 4(*b*) show a construction of one of a pair of DY 2-pole magnets composing the aforementioned DY 2-pole magnets 10. FIG. 4(*a*) presents a top plan view, and FIG. 4(*b*) presents a side elevation.

The DY 2-pole magnet 10 is made of an annular plate (having a thickness of 1 to 1.5 mm), in which there is formed a hole 10A for accommodating the neck portion 1B of the color cathode ray tube. With this DY 2-pole magnet 10, there is integrally formed a pair of knobs 10B for turning the magnet to adjust the DY 2-pole magnet 10 around the neck portion 1B. This DY 2-pole magnet 10 is made mainly of magnetized soft iron to have N and S poles at positions, as shown in FIG. 4(*a*).

The paired DY 2-pole magnets 10, as arranged at the neck portion 1B, are arranged so that their individual S poles and N poles overlap when the adjustments of the positions of the electron beams are unnecessary. In this state, the magnetic fields of the individual magnets are canceled to produce the weakest state. When the positions of the electron beams are to be adjusted, the individual DY 2-pole magnets 10 are turned according to the positional adjustments required for the electron beams.

Figure 5:
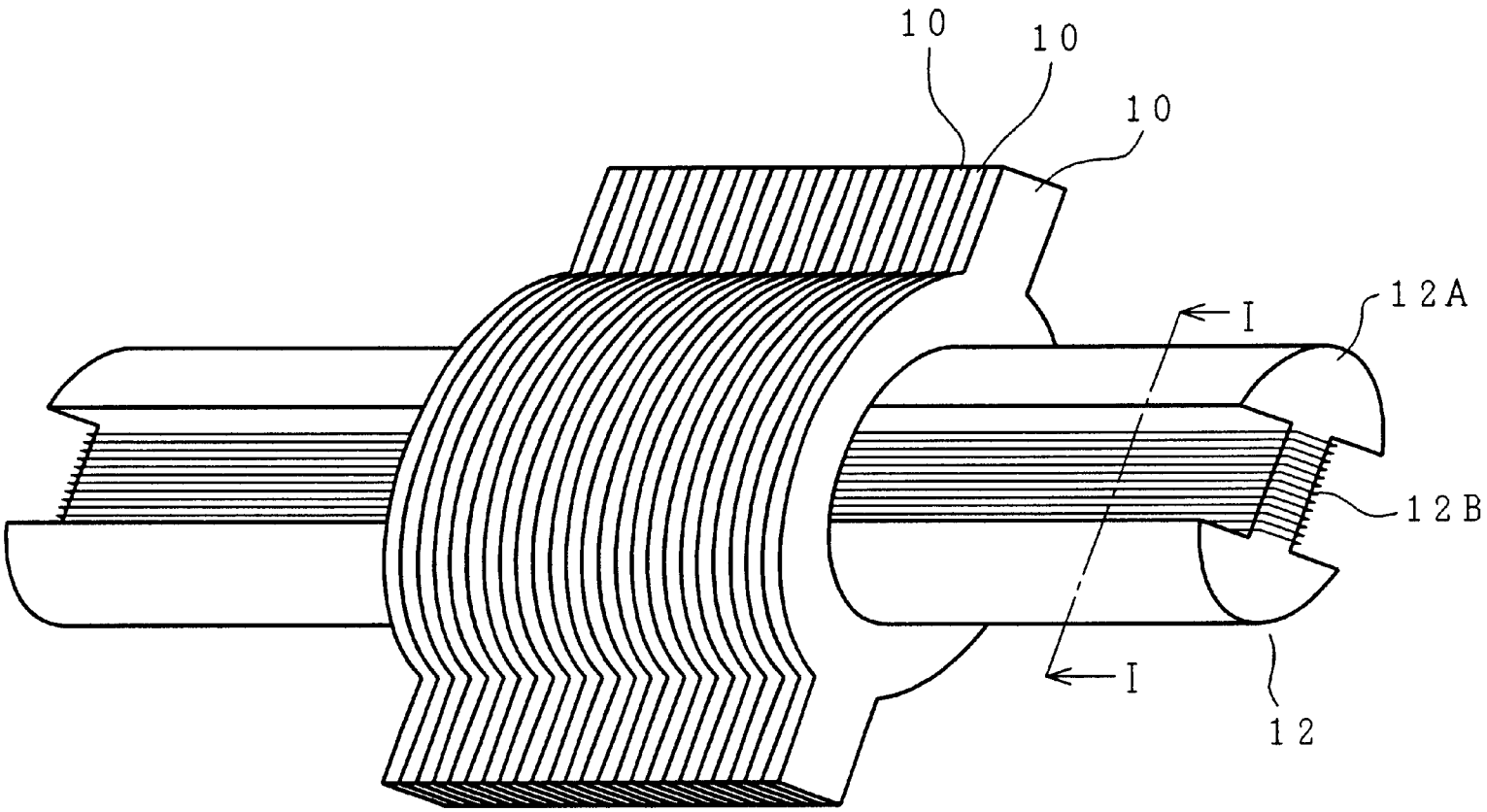
FIG. 5 is a diagram for explaining a method of magnetizing the DY 2-pole magnet of the color cathode ray tube according to the embodiment of the invention.
Figure 6:
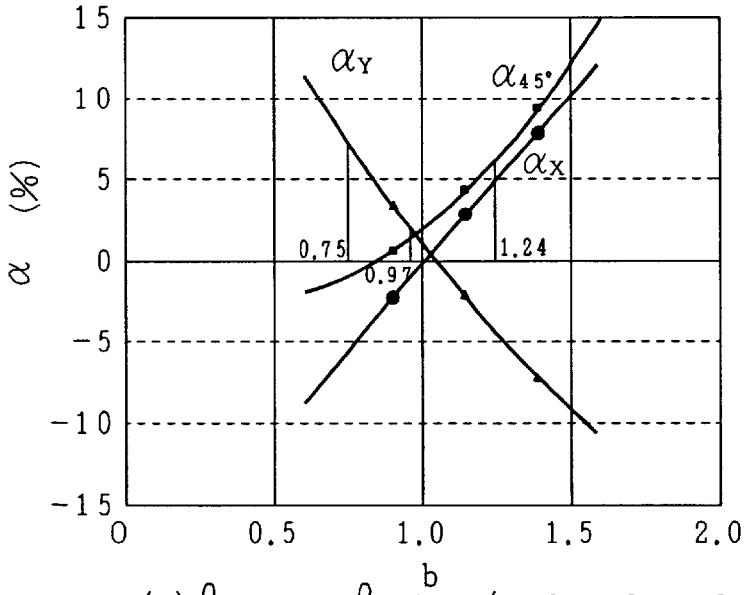
FIG. 6 is a graph plotting the evaluation results of a center-side difference of an electron beam shift against the width of an umbrella, as normalized by the radius of a magnetizing yoke.
Figure 7:
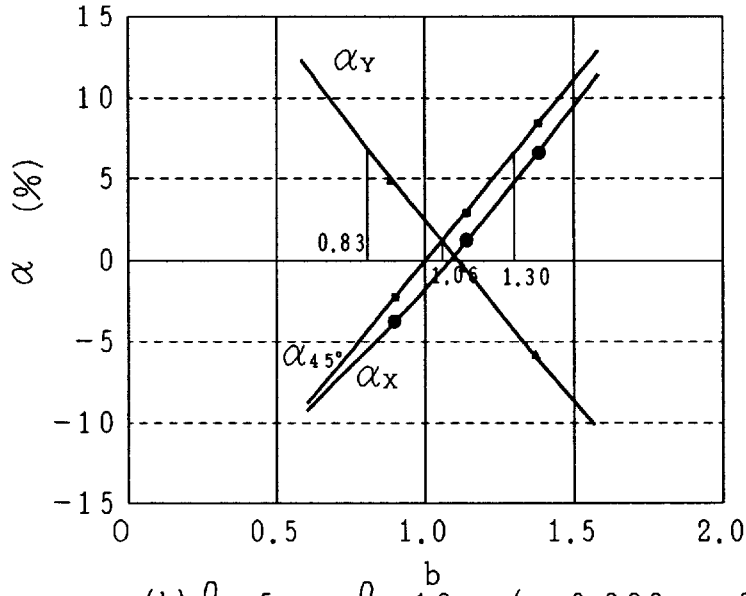
FIG. 7 is a graph plotting the evaluation results of a center-side difference of an electron beam shift against the width of an umbrella-shaped yoke portion, as normalized by the radius of a magnetizing yoke.

FIG. 5 is a diagram for explaining a method of magnetizing the DY 2-pole magnet 10. As shown in FIG. 5, a magnetizing yoke 12, in which a coil 12B is wound on a magnetic core 12A, is arranged to extend through the holes 10A of a plurality of piled-up DY 2-pole magnets 10. Then, an electric current at a predetermined value is fed for a predetermined time period to the coil 12B of the magnetizing yoke 12 so that the individual DY 2-pole magnets 10 may be magnetized by the magnetic field thus generated.

Figure 1:
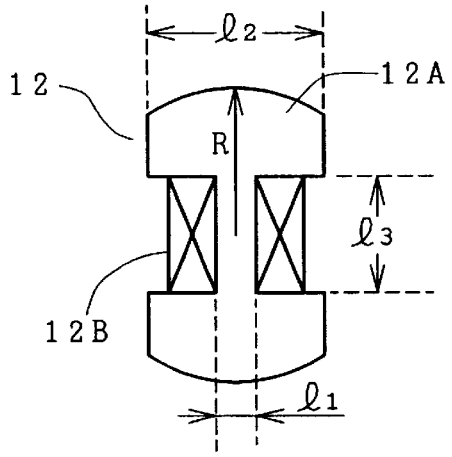
FIG. 1 is a diagram showing a magnetizing yoke to be used for magnetizing a DY 2-pole magnet of a color cathode ray tube according to an embodiment of the invention.

FIG. 1 is a section through the magnetizing yoke 12, taken along line I—I of FIG. 5. The magnetizing yoke 12 of this embodiment is characterized in that an umbrella portion covering the coil element (the coil 12B) has a longer width $\mathbf{1}_2$ than the spacing $\mathbf{1}_3$. Here it is assumed that letters a, b and c represent the umbrella spacing $\mathbf{1}_3$, the umbrella width $\mathbf{1}_2$ and coil layer spacing $\mathbf{1}_1$, respectively, which are normalized by the radius R (14.75 mm) of the magnetizing yoke 12, as expressed by $\mathbf{1}_3$/R=a, $\mathbf{1}_2$/R=b, and $\mathbf{1}_1$/R=c, then the values $\mathbf{1}_1$, $\mathbf{1}_2$, $\mathbf{1}_3$ and R are individually set to satisfy the following Formula (1):

$$b=0.592a^2-0.591a+1.123\pm0.25 \quad (1).$$

The reason why the values $\mathbf{1}_1$, $\mathbf{1}_2$, $\mathbf{1}_3$ and R are thus set will be detailed in the following.

By using a variety of magnetizing yokes 12 having a different coil layer spacing $\mathbf{1}_1$, umbrella width $\mathbf{1}_2$ and umbrella spacing $\mathbf{1}_3$, the DY 2-pole magnets 10 were magnetized. Then, under the influence of magnetic fields of the magnet, the maximum of the absolute values of the differences between the shifts of the center electron beam and the side electron beams normalized by the center beam shift (hereinafter referred to as the "center-side difference" and denoted by $\alpha$) is evaluated.

Here, the center-side differences $\alpha$ of the electron beam shifts were evaluated for the three cases ($\alpha_x$, $\alpha_y$, $\alpha_{45degrees}$) when the magnetic field is directed in the y-direction (when the beam is shifted in the x-direction), when the magnetic field is directed in the x-direction (when the beam is shifted in the y-direction) and when the magnetic field is directed in a direction of −45 degrees from the x-axis (when the beam is shifted in the direction of +45 degrees from the x-axis).

FIGS. 6 to 10 plot the experimental results. In FIGS. 6 to 10, letters a, b and c represent the umbrella spacing $\mathbf{1}_3$, umbrella width $\mathbf{1}_2$ and coil layer spacing $\mathbf{1}_1$, respectively, which are normalized by the radius R (14.75 mm) of the magnetizing yoke 12. That is, $\mathbf{1}_3/R \equiv a$, $\mathbf{1}_2 R \equiv b$, and $\mathbf{1}_1/R \equiv c$.

Figure 10:
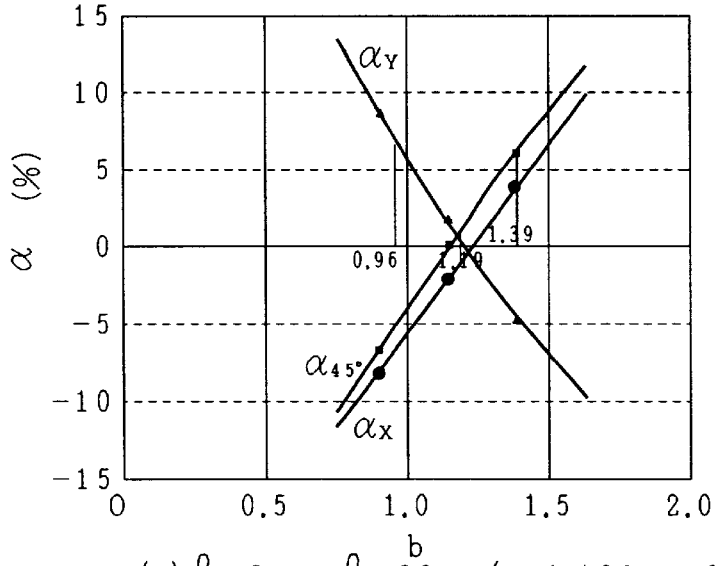
FIG. 10 is a graph plotting the evaluation results of a center-side difference of an electron beam shift against the width of an umbrella-shaped yoke portion, as normalized by the radius of a magnetizing yoke.

FIGS. 6 to 9 plot the relations between the umbrella width $\mathbf{1}_2$ (i.e., b) and the center-side difference $\alpha$ when the coil layer spacing $\mathbf{1}_1$ is fixed at 5 mm, while the umbrella spacing $\mathbf{1}_3$ is changed sequentially to 8 mm, 12 mm, 16 mm and 20 mm, and FIG. 10 plots the same relation when the coil layer spacing $\mathbf{1}_1$ is set at 8 mm, while the umbrella spacing $\mathbf{1}_3$ is set to 20 mm.

Figure 8:
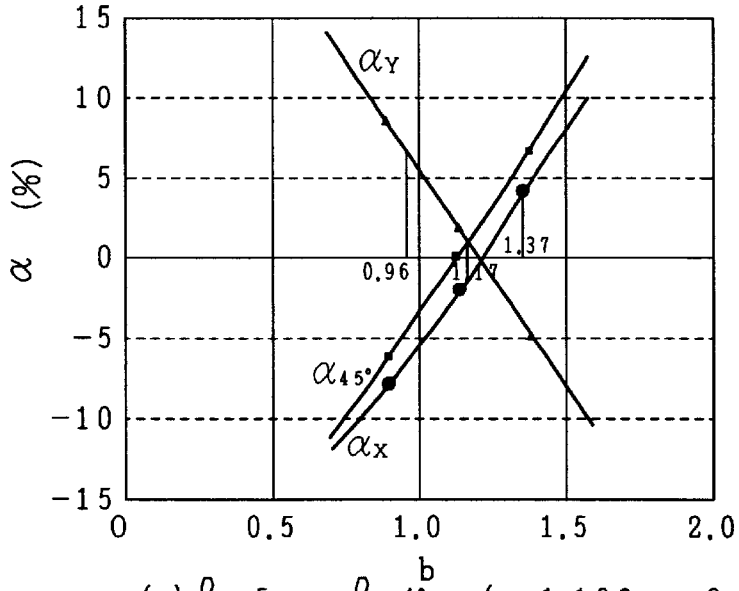
FIG. 8 is a graph plotting the evaluation results of a center-side difference of an electron beam shift against the width of an umbrella-shaped yoke portion, as normalized by the radius of a magnetizing yoke.
Figure 9:
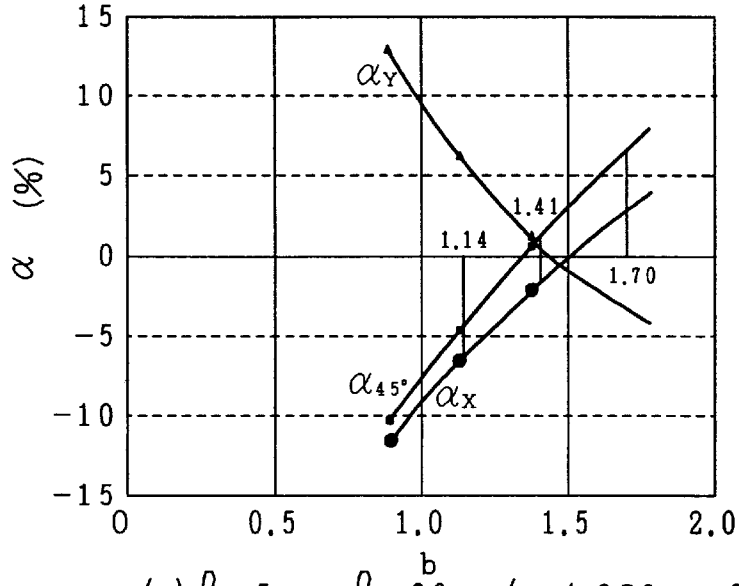
FIG. 9 is a graph plotting the evaluation results of a center-side difference of an electron beam shift against the width of an umbrella-shaped yoke portion, as normalized by the radius of a magnetizing yoke.

FIG. 8 and FIG. 10 (for which only the value $\mathbf{1}_1$ is different) will be compared. This comparison reveals that the coil layer spacing $\mathbf{1}_1$ exerts little influence upon the characteristics of the DY 2-pole magnets 10. This means that the coil layer spacing $\mathbf{1}_1$ is not important for the characteristics of the DY 2-pole magnets 10.

From the individual graphs of FIGS. 6 to 10, moreover, it has been found that for a larger value b, the value $\alpha_y$ decreases whereas the values $\alpha_x$ and $\alpha_{45degrees}$ increase, and that there exists a value b which can minimize the maximum of the absolute values of $\alpha_x$, $\alpha_y$ and $\alpha_{45degrees}$. The maximum of the absolute values of the center-side difference $\alpha$ is desired to be within one half (6.6%) of the prior art. FIGS. 6 to 10 plot the value b($b_{opt}$), for which the maximum for the value $\alpha$ becomes the least, and the value b (b+, b−) for which the maximum for the value $\alpha$ is 6.6%.

Figure 11:
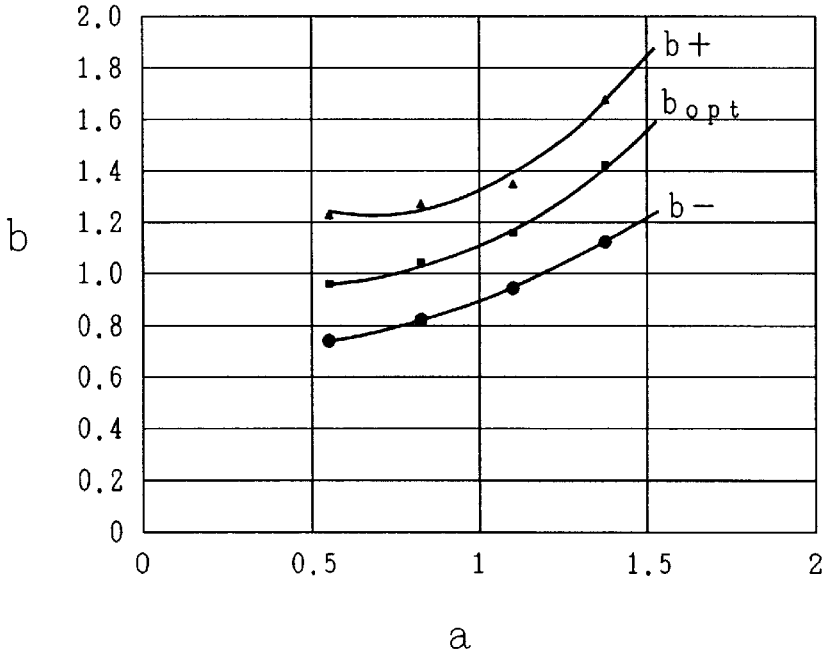
FIG. 11 is a graph plotting values of the width b of an umbrella, as normalized by the radius of the magnetizing yoke for the least maximum value, and the values of the width b for the maximum of 6.6%, against the spacing a of the umbrella-shaped yoke portion, as normalized by the radius of the magnetizing yoke.

FIG. 11 plots the value b ($b_{opt}$), for which the maximum for the value $\alpha$ becomes the least, and the value b (b+, b−) for which the maximum for the value $\alpha$ is 6.6%. The value b($b_{opt}$), for which the maximum for the value $\alpha$ becomes the least, increases with the increase in the value $\alpha$, and this relation can be approximated by the following Formula (2):

$$b=0.592a^2-0.591a+1.123 \quad (2).$$

Since the range in which the maximum for the value $\alpha$ is within 6.6% is ±0.25 of the Formula (2), moreover, the center-side difference $\alpha$ of the beam shifts can be reduced to one half or less of the conventional device by setting the value b within that range:

$$0.592a^2-0.591a+0.87 \leqq b \leqq 0.592a^2-0.591a+1.37$$

Figure 12:
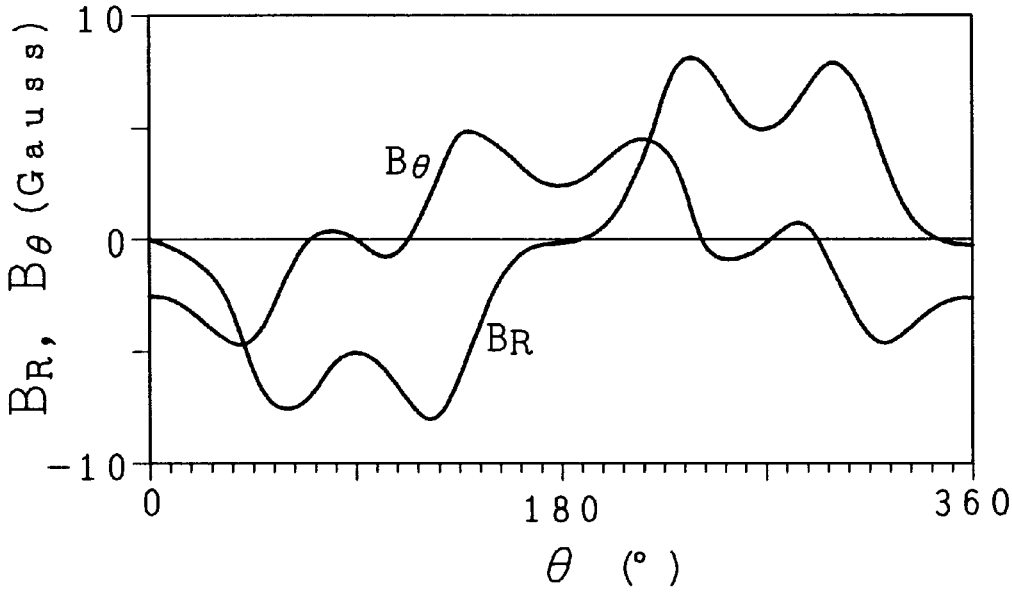
FIG. 12(*a*) is a graph plotting the distribution of a magnetic field on a circumference of a radius of 10 mm of the DY 2-pole magnet of the color cathode ray tube according to the embodiment of the invention.
Figure 12:
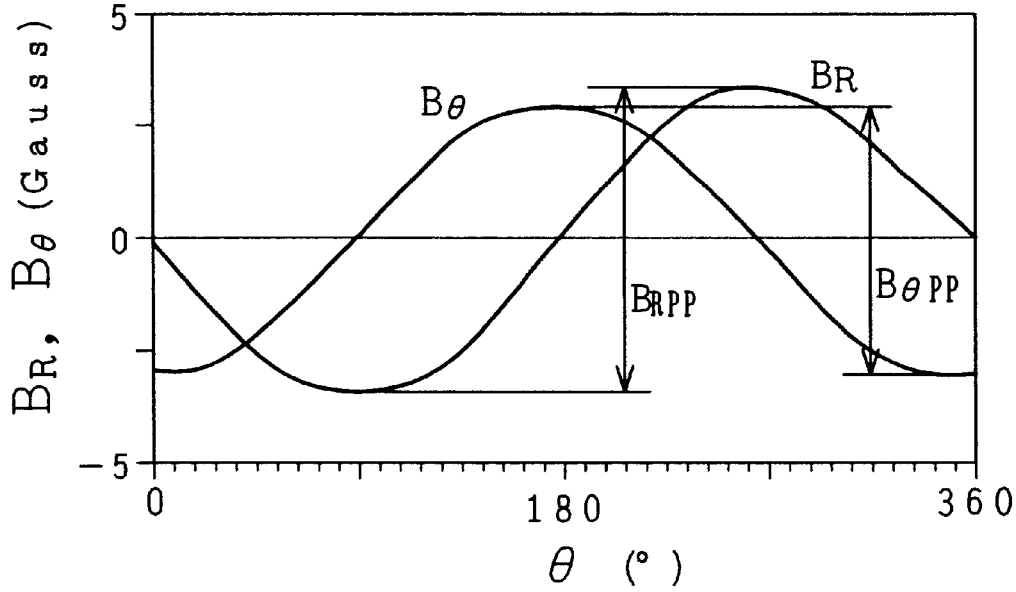

FIGS. 12(*a*) and 12(*b*) illustrate magnetic field distributions ($B_R$, $B_\Theta$) on the circumference of the DY 2-pole magnet of this embodiment. In this embodiment, the DY 2-pole magnet 10 was magnetized by using a magnetizing yoke in which $\mathbf{1}_1$=5 mm, $\mathbf{1}_2$=16.5 mm, $\mathbf{1}_3$=16 mm, and R=14.75 mm. Here, the distribution $B_R$ indicates the radial component of the magnetic flux density, and the distribution $B_\Theta$ indicates the circumferential component of the magnetic flux density.

FIGS. 12(*a*) and 12(*b*) illustrate the magnetic field distributions on circumferences having a radius of 10 mm and a radius of an s size (of 4.75 mm), respectively. In the magnetic field distributions, as seen from FIG. 12(*a*), the radial magnetic field distribution $B_R$ has an extended spacing between two crests or troughs. As a result, both of the magnetic field distributions $B_R$ and $B_\Theta$ on the circumference having the radius of the s size approach a sinusoidal distribution and have similar amplitudes, as seen from FIG. 12(*b*).

Figure 13:
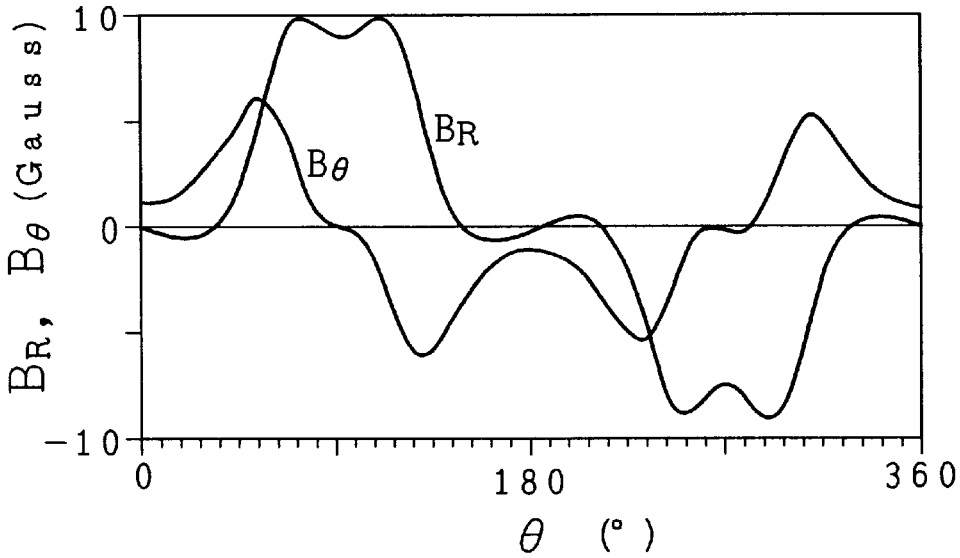
FIG. 13 (a) (PRIOR ART)
FIG. 13(*a*) is a graph plotting the distribution of a magnetic field on a circumference of a radius of 10 mm of the DY 2-pole magnet of the color cathode ray tube of the prior art.
Figure 13:
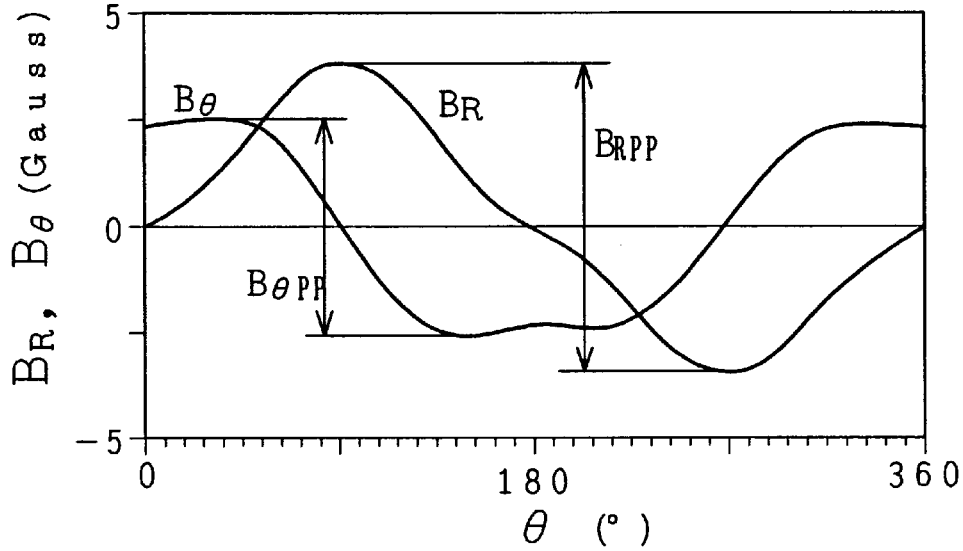
FIG. 13 (b) (PRIOR ART)

FIGS. 13(*a*) and 13(*b*) illustrate the magnetic field distributions of the DY 2-pole magnet of the prior art. FIGS. 13(*a*) and 13(*b*) are graphs similar to the foregoing FIGS. 12(*a*) and 12(*b*). In the DY 2-pole magnet of the prior art, the magnetic field on a circumference of a radius of 10 mm near the magnet is influenced by the magnetization as it is, such that the radial component $B_R$ takes a maximum absolute value in the vicinity of the top and bottom (at $\Theta$=90 and 270 degrees) of the core of the magnetizing yoke and such that two crests or troughs of the magnetic field appear nearby. The distribution of the radial component $B_R$ on the circumference of the s size (or 4.75 mm), through which the electrons on the sides of the red (R) and blue (B) beams pass, still retains the influences of the magnetization, although considerably relaxed.

Here, the ideal DY 2-pole magnet has the object to shift the three electron beams of the red (R), green (G) and blue (B) colors uniformly. Hence, the DY 2-pole magnet is ideal if it exhibits a completely uniform magnetic field distribution (in which the magnetic field vector has a constant length and a fixed direction in a section (x, y) or in which the magnetic field scholar has a coarse contour).

Figure 14:
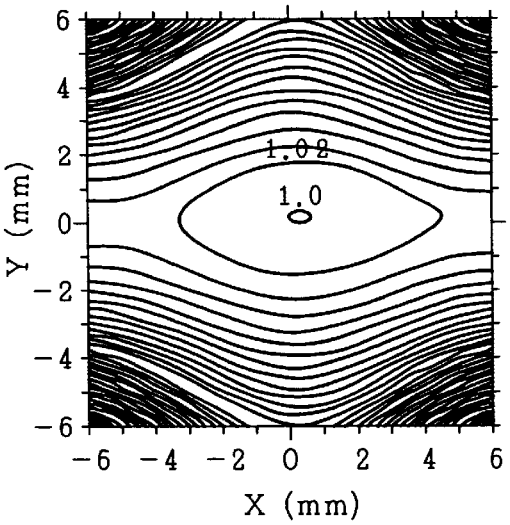
FIG. 14(*a*) is a diagram showing the distribution of a magnetic field in a (x, y) section at the center of the DY 2-pole magnet of the color cathode ray tube according to the embodiment of the invention.
Figure 14:
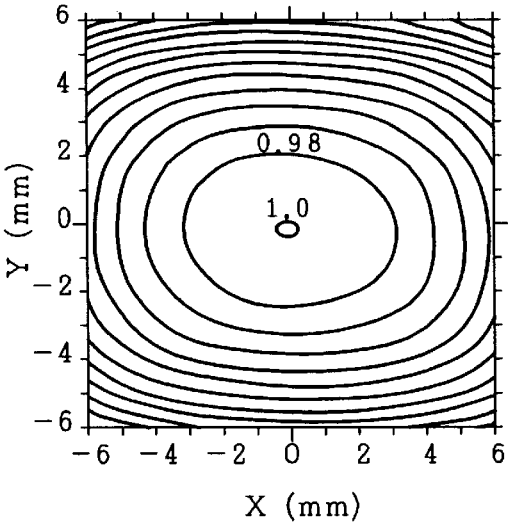

FIG. 14(*a*) illustrates a magnetic field distribution in the section (x, y) at the center of the DY 2-pole magnet 10 of this embodiment. FIG. 14(*b*) illustrates the magnetic field distribution in the section (x, y) spaced by 10 mm in the z-direction from the center of the DY 2-pole magnet of this embodiment, and FIG. 14(*b*) also illustrates the magnetic field distribution (which is normalized by the center value and displayed by every 2%: within a range of ±6 mm for x and y), which expresses a scholar $\sqrt{((B_X)^2+(B_Y)^2)}$ by contours.

From FIGS. 14(*a*) and 14(*b*), it is found in the DY 2-pole magnet 10 of this embodiment that the magnetic field distribution on the x-axis rather increases at the center from the center point to the circumference, but decreases in the section (x, y) spaced by 10 mm. It is likewise found that the magnetic field distribution on the y-axis rather increases at the center from the center point to the circumference, but decreases in the section (x, y) spaced by 10 mm.

This implies that the magnetic field distribution is not always uniform in a section. However, a comparison with the case of the DY 2-pole magnet of the prior art has revealed that the DY 2-pole magnet of this embodiment has a coarse contour at the center in the magnetic field scholar so that the uniformity of the magnetic field distribution is improved. The DY 2-pole magnet of this embodiment is given an effect capable of reducing the unbalance of the beam shifts of the red (R) and blue (B) colors by improving the uniformity of the magnetic field distribution, even if the magnetization is eccentric or offset.

Figure 15:
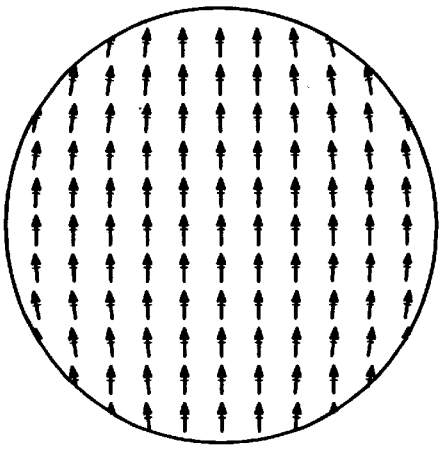
FIG. 15 (a) (PRIOR ART)
FIG. 15(*a*) is a diagram showing the distribution of a magnetic field vector at the central portion of the DY 2-pole magnet of the color cathode ray tube of the prior art.
Figure 15:
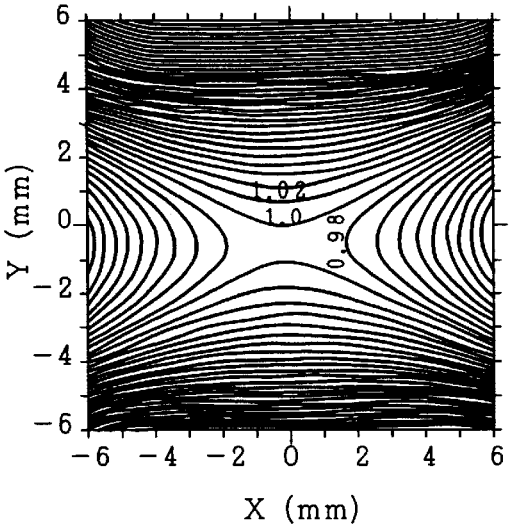
FIG. 15 (b) (PRIOR ART)

The magnetic field distribution at the magnet center of the DY 2-pole magnet of the prior art is illustrated in FIGS. 15(*a*) and 15(*b*). FIG. 15(*a*) illustrates the magnetic field distribution, as expressed by a vector ($B_X$, $B_Y$), within a range of a radius of 6 mm. On the other hand, FIG. 15(*b*) illustrates the magnetic field distribution (which is normalized by the center value and displayed by every 2%: within a range of ±6 mm for x and y), which expresses a scholar $\sqrt{((B_X)^2+(B_Y)^2)}$ by contours.

It is apparent from FIG. 15(*a*) that the magnetic field distribution is not uniform in the DY 2-pole magnet of the prior art but that the magnetic field becomes stronger the farther from the center in a direction parallel to the magnetic field but weaker the farther in a direction perpendicular to the magnetic field. As apparent from FIG. 15(*b*), moreover, the magnetization is offset by −0.5 mm in the y-direction in the DY 2-pole magnet of the prior art.

Figure 16:
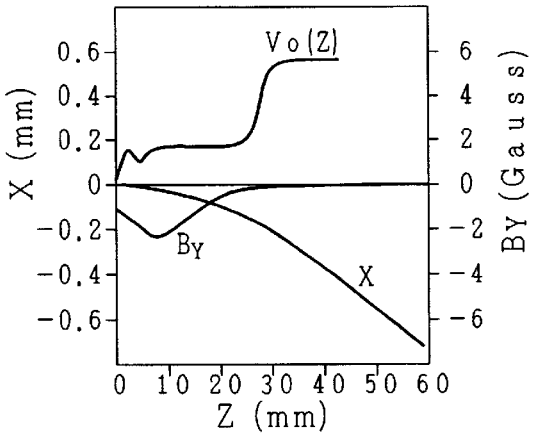
FIGS. 16(*a*) to 16(*f*) are graphs, in which solid curves plot the center trajectories, axial potential distributions and axial field distributions of the individual electron beams of red (R), green (G) and blue (B) colors when the magnetic field is maximized in a horizontal direction (or x-direction) by adjusting the angle of rotation of the DY 2-pole magnet of the color cathode ray tube according to the embodiment of the invention, whereas dashed line curves plot those of the case of the DY 2-pole magnet of the prior art.
Figure 16:
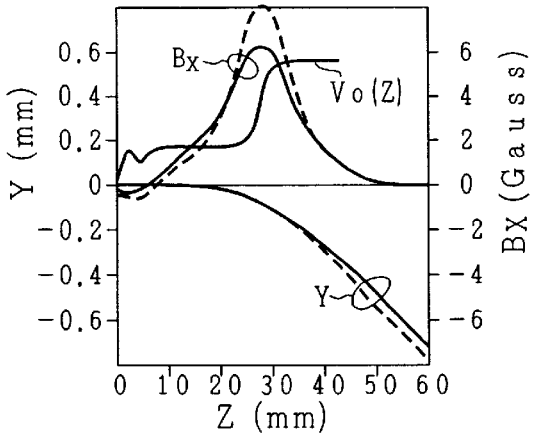
Figure 16:
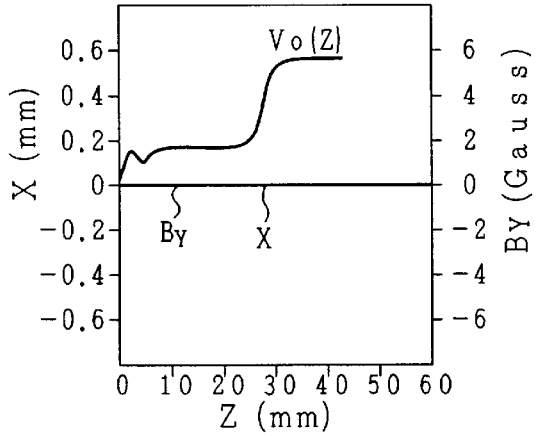
Figure 16:
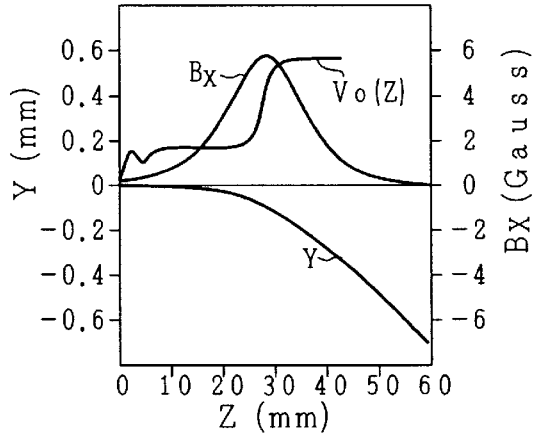
Figure 16:
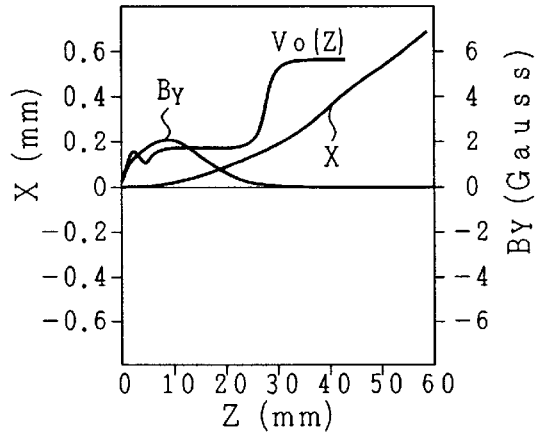
Figure 16:
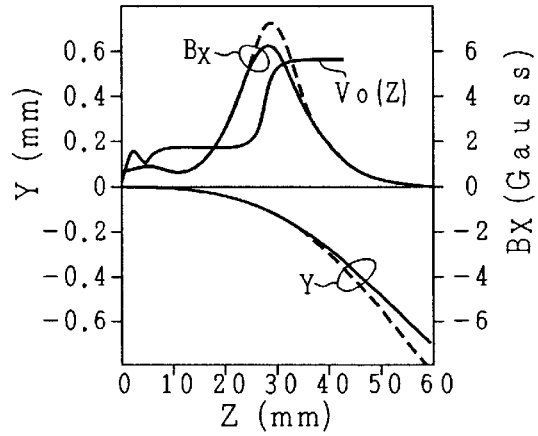

FIGS. 16(*a*) to 16(*f*) are graphs illustrating center trajectories (X, Y), axial potentials ($V_0(Z)$) and axial magnetic fields ($B_X$, $B_Y$) of the individual electron beams of the red (R), green (G) and blue (B) colors when the magnetic field is maximized in the horizontal x-direction by adjusting the angle of rotation of the DY 2-pole magnet of this embodiment. FIGS. 16(*a*) to 16(*f*) illustrate the trajectory 60 mm from the cathode of the electron gun. Here, this embodiment has a length of 320 mm from the electron gun to the screen.

Here, the origins of the electron beams of the red (R) and blue (B) colors, as taken in the x-coordinates, on the two sides are illustrated with shifts of ±s=4.75 mm from the origin of the electron beam of the green (G) color in the x-coordinate. The electron beam trajectory was determined by the electron trajectory analysis considering the magnetic fields of the 2-pole and 4-pole magnets and the electric field of the electron gun. This electron trajectory analysis was performed by using the actually measured values for the magnetic field and the analyzed values for the electric field.

In the DY 2-pole magnet of this embodiment, as illustrated in FIGS. 16(*a*), 16(*c*) and 16(*e*), the electron beam of the green (G) color goes generally straight on the tube axis z in the (x-z) section, but the individual electron beams of the red (R) and blue (B) colors are individually deflected inward by the actions of both the magnetic field (of which the y-direction magnetic field is given the opposite polarities in the individual electron beams of the red (R) and blue (B) colors) of the 4-pole magnets and the electric field of the main lens.

In the DY 2-pole magnet of this embodiment, moreover, it is found from the solid curves of FIGS. 16(*b*), 16(*d*) and 16(*f*), that the trajectories of the electron beams are not seriously deflected in the vertical y-direction by the x-direction magnetic field of the 2-pole magnets, and that the peak values of the axial magnetic field B(x) for the individual electron beams of the blue (B) and red (R) colors are not larger than that of the axial magnetic field for the electron beam of the green (G) color.

In the case of the 2-pole magnet of the prior art, on the contrary, the electron trajectory is seriously deflected in the vertical y-direction by the x-direction magnetic field of the 2-pole magnet, as illustrated by the dashed-line curves of FIGS. 16(*b*), 16(*d*) and 16(*f*). It is accordingly found that the peak values of the axial magnetic field B(x) for the individual electron beams of the blue (B) and red (R) colors are larger than that of the axial magnetic field for the electron beam of the green (G) color, so that the shifts of the individual electron beams of the blue (B) and red (R) colors are higher by 10% or more than that of the electron beam of the green (G) color.

Figure 17:
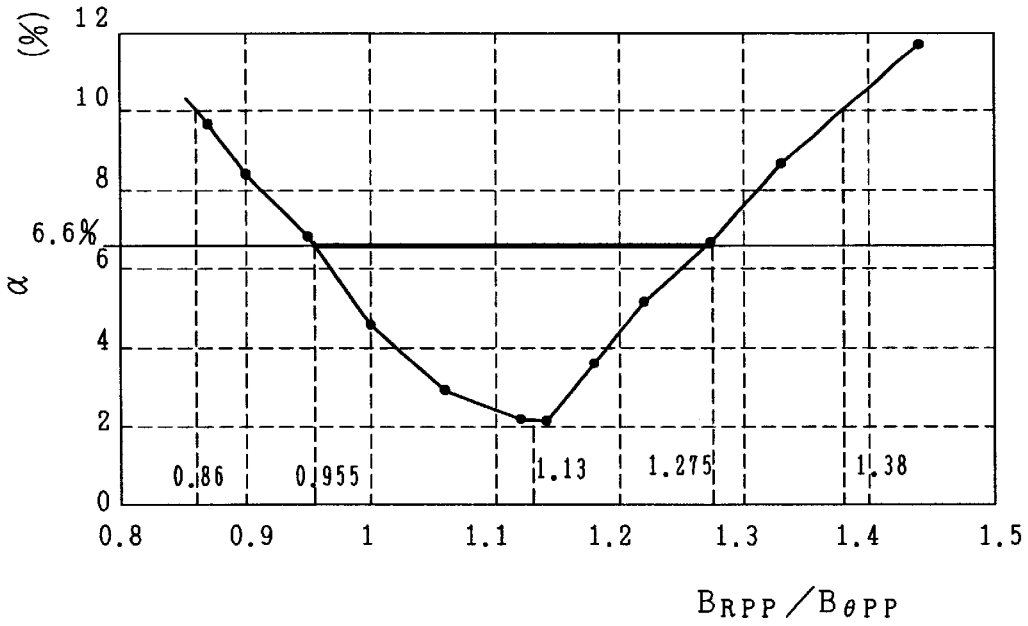
FIG. 17 is a graph plotting a relation between $B_{RPP}/B_{\theta PP}$ and $\alpha$ of the DY 2-pole magnet of the color cathode ray tube according to the embodiment of the invention.

FIG. 17 is a graph plotting a relation between the value $B_{RPP}/B_{\Theta PP}$ and the value α of the DY 2-pole magnet of this embodiment. Here, letters $B_{RPP}$ indicate the amplitude (i.e. the difference between maximum and minimum values as shown in FIGS. 12(*a*) and 13(*b*)) of the radial component of the magnetic field distribution on the circumference of the radius of the s size of the DY 2-pole magnet 10 of this embodiment, and letters $B_{\Theta PP}$ indicate the amplitude (i.e. the difference between maximum and minimum values as shown in FIGS. 12(*a*) and 13(*b*)) of the circumferential component.

It is found from FIG. 17 that the center-side differences α are a function of the value $B_{RPP}/B_{\Theta PP}$ so that the value $B_{RPP}/B_{\Theta PP}$ and the value α are substantially completely in a correlation. The center-side differences α should be less than 10% and preferably within one half of the prior art, i.e., 6.6%, therefore, it is understandable that the value $B_{RPP}/B_{\Theta PP}$ should be within a range from 0.86 to 1.38 and preferably within a range from 0.955 to 1.275.

If the magnetic field is completely uniform in the entire space, $B_{RPP}/B_{\Theta PP}=1$. Since the actual magnetic field distribution changes in the axial z-direction of the cathode ray tube, it has been confirmed that the uniformity of the beam shift is improved the best for $B_{RPP}/B_{PP}=1.13$, as shifted from $B_{RPP}/B_{\Theta PP}=1$.

Table 1 enumerates the beam shifts and the center-side differences α for the DY 2-pole magnet 10 of this embodiment. Table 1 also enumerates the beam shifts when the trajectory analysis calculations of the electron beam are executed up to the phosphor screen.

TABLE 1

| | MF (y-direction) | MF (x-direction) |
|---|---|---|
| $\Delta X_G$(mm) | −5.456 | −0.003 |
| $\Delta Y_G$(mm) | 0.005 | −5.472 |
| $\Delta X_B$(mm) | −5.346 | 0.037 |
| $\Delta Y_B$(mm) | −0.036 | −5.532 |
| $\Delta X_R$(mm) | −5.336 | −0.022 |
| $\Delta Y_R$(mm) | 0.066 | −5.616 |
| α(%) | −2.1 | 1.9 |

Here, MF: magnetic Field.

Table 2 enumerates the electron beam shifts and the center-side differences α by the DY 2-pole magnet of the prior art.

TABLE 2

| | MF (y-direction) | MF (x-direction) |
|---|---|---|
| $\Delta X_G$(mm) | 5.460 | 0.090 |
| $\Delta Y_G$(mm) | 0.088 | −5.469 |
| $\Delta X_B$(mm) | 4.842 | 0.084 |
| $\Delta Y_B$(mm) | −0.067 | −5.966 |
| $\Delta X_R$(mm) | 4.758 | 0.166 |
| $\Delta Y_R$(mm) | 0.169 | −6.412 |
| α(%) | −12.1 | 13.2 |

Here, MF: Magnetic Fie1d.

Here, in Table 1, the magnetic field intensity was set to 1.68 times as high as that of the DY 2-pole magnet of the prior art so that the shifts of the electron beam of the green (G) color might be substantially equalized to those of Table 2. In Tables 1 and 2, moreover, the shifts of the center trajectories of the individual electron beams of the red (R), green (G) and blue (B) colors by the DY 2-pole magnet for the magnetic field in the (y, x) direction are expressed by:

$$\Delta r_B=(\Delta X_B, \Delta Y_B) \quad (3);$$

$$\Delta r_G=(\Delta X_G, \Delta Y_G) \quad (4);$$

and $$\Delta r_R=(\Delta X_R, \Delta Y_R) \quad (5).$$

In addition, the center-side differences α (i.e., the values which are normalized by the shift of the electron beam of the green (G) color from the differences between the average value of the shifts of the individual electron beams of the blue (B) and red (R) colors and the shift of the green (G) color) of the electron beam shifts are expressed by:

$$\alpha=((\Delta r_B \cdot n+\Delta r_R \cdot n)/2-\Delta r_G \cdot n)/(\Delta r_G \cdot n) \quad (6).$$

Here, letter n appearing in Formula (6) indicates a unit vector, as taken in the shift direction, of the electron beam of the green (G) color, as expressed by:

$$n=\Delta r_G|\Delta r_G| \quad (7).$$

The center-side differences α of the electron beam shift, as taken in the x-direction, when the magnetic field of the DY 2-pole magnet is in the y-direction, is expressed by:

$$\alpha x=((\Delta x_B+\Delta x_R)/2=\Delta x_G)/\Delta x_G \quad (8)$$

The center-side differences α of the electron beam shift, as taken in the y-direction, when the magnetic field of the DY 2-pole magnet is in the x-direction, is expressed by:

$$\alpha y=((\Delta y_B+\Delta y_R)/2=\Delta y_G)/\Delta y_G \quad (9)$$

According to this embodiment, as enumerated in Table 1, the center-side differences α of the electron beam shift are improved from about 12 to 13% of the DY 2-pole magnet of the prior art to about 2% (one sixth or less). This drastic improvement in the center-side differences α of the electron beam shifts according to this embodiment, although the magnetic field distribution in a section is not always uniform, is thought to be caused by the fact that the Lorentz's force integrated in the CRT axial direction (or the z-direction) is made uniform to make the electron beam shifts uniform.

As enumerated in Table 2, the difference between the y-direction shifts $\Delta y_B$ and $\Delta y_R$ of the individual electron beams of the red (R) and blue (B) colors for the magnetic field in the x-direction is as large as about 8% in the DY 2-pole magnet of the prior art, when it is normalized by $(\Delta y_B+\Delta y_R)/2$. This unbalance between the individual beam shifts of the red (R) and blue (B) colors is caused by the eccentricity of the magnetization, as plotted in FIG. 9(*b*).

Figure 18:
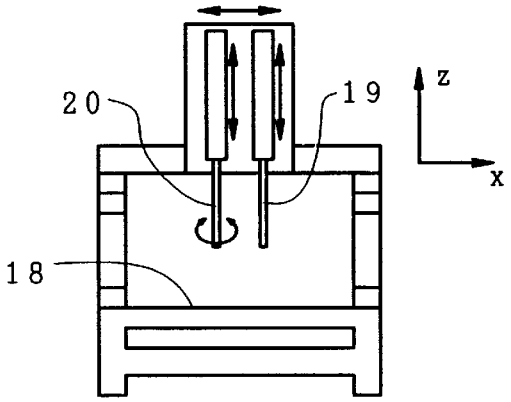
FIG. 18(*a*) is a front elevation showing a three-dimensional magnetic field measuring apparatus.
Figure 18:
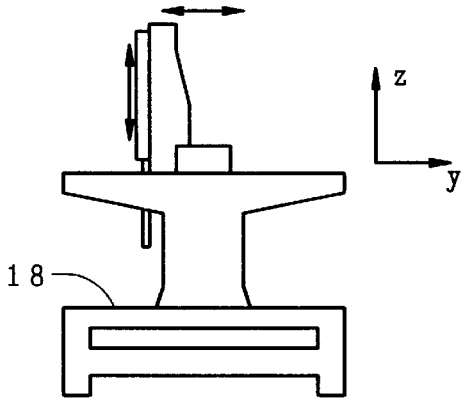
Figure 19:
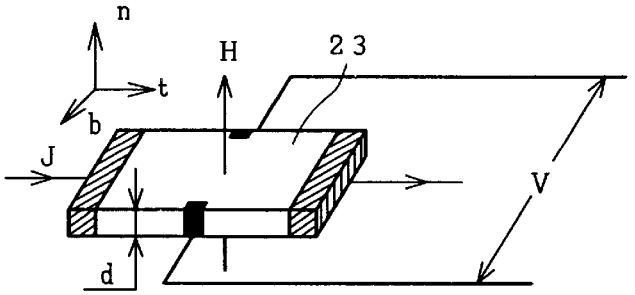
FIG. 19 is a diagram for explaining a measuring principle of a measuring probe of the three dimensional magnetic field measuring apparatus.

Here, the magnetic field of the magnet in this embodiment was measured by placing a magnet to be measured on a sample stage 22 of a three-dimensional magnetic field measuring apparatus, as shown in FIGS. 18(*a*) and 18(*b*), and by adjusting the influences of the earth magnetism with the room temperature (at 22° C.) while moving a z-direction magnetic field measuring probe 19 and an x- and y-direction magnetic field measuring probe 20 to predetermined positions. Here, these magnetic field measuring probes employ a Hall element 23, as shown in FIG. 19, so that the intensity of a magnetic field H is detected in terms of a voltage V from an electric current J flowing through the Hall element.

The above description was made mainly for the case of a one piece 2-pole magnet. However, for a pair of 2-pole magnets, such as used in the actual products, the beam shift can be interpreted as a maximum beam shift.

What is claimed is:

1. A color cathode ray tube comprising:

a vacuum vessel including a panel portion having a phosphor screen on its inner face, a neck portion and a funnel portion joining said neck portion and said panel portion;

an inline electron gun, disposed inside of said neck portion, including a main lens and a cathode and producing a center electron beam and two side electron beams;

a deflection yoke for deflecting said electron beams; and a pair of 2-pole ring magnets for adjusting electron beam trajectory, disposed around said neck portion, said 2-pole ring magnets having a magnetic flux density distribution at a circle which is concentric with said ring magnets, a radius of said circle corresponding to a distance between adjacent electron beams at the main lens, a ratio of amplitude of flux density in a radial component compared to an amplitude of the flux density in a circumferential component being 0.86 to 1.38 on said circle;

wherein a difference in maximum beam shift between the center electron beam and a side electron beam produced by said pair of 2-pole ring magnets is less than 10%.

2. A color cathode ray tube according to claim 1, wherein said pair of ring magnets has the ratio of the amplitude of said flux density in the radial component compared to the amplitude of said flux density in the circumferential component of 0.955 to 1.275 on said circle.

3. A color cathode ray tube according to claim 1, wherein the difference in maximum beam shift between the center electron beam and a side electron beam produced by said pair of 2-pole ring magnets is less than 6.6%.

4. A color cathode ray tube comprising:

a vacuum vessel including a panel portion having a phosphor screen on its inner face, a neck portion and a funnel portion joining said neck portion and said panel portion;

an inline electron gun, disposed inside of said neck portion, including a main lens and a cathode and producing a center electron beam and two side electron beams;

a deflection yoke for deflecting said electron beams; and a magnet assembly to adjust electron beam trajectory comprising a first pair of 2-pole ring magnets, a pair of 4-pole ring magnets, and a pair of 6-pole ring magnets disposed around the neck portion, and a second pair of 2-pole ring magnets for adjusting electron beam trajectory disposed around said neck portion and arranged so that a center of said second pair of 2-pole magnets is close to the phosphor screen side relative to a center of said main lens and said first pair of 2-pole ring magnets, said first pair of 2-pole ring magnets having a magnetic flux density distribution at a circle which is concentric with said ring magnets, a radius of said circle corresponding to a distance between adjacent electron beams at the main lens, a ratio of amplitude of flux density in a radial component compared to an amplitude of said flux density in a circumferential component being 0.86 to 1.38 on said circle;

wherein a difference in maximum beam shift between the center electron beam and a side electron beam produced by said first pair of 2-pole ring magnets is less than 10%.

5. A color cathode ray tube according to claim 4, wherein said first pair of ring magnets having the ratio of the amplitude of said flux density in the radial component compared to the amplitude of said flux density in the circumferential component of 0.955 to 1.276 on said circle.

6. A color cathode ray tube according to claim 4, wherein the difference in maximum beam shift between the center electron beam and a side electron beam produced by said first pair of 2-pole ring magnets is less than 6.6%.

7. A color cathode ray tube comprising:

a vacuum vessel including a panel portion having a phosphor screen on its inner face, a neck portion and a funnel portion joining said neck portion and said panel portion;

an inline electron gun, disposed inside of said neck portion, including a main lens and a cathode and producing a center electron beam and two side electron beams;

a deflection yoke for deflecting said electron beams; and a magnet assembly to adjust electron beam trajectory comprising a first pair of 2-pole ring magnets, a pair of 4-pole ring magnets, and a pair of 6-pole ring magnets disposed around the neck portion, and a second pair of 2-pole ring magnets for adjusting electron beam trajectory disposed around said neck portion and arranged so that a center of said second pair of 2-pole magnets is close to a phosphor screen side relative to a center of said main lens and said first pair of 2-pole ring magnets, said first pair of 2-pole ring magnets and said second pair of 2-pole ring magnets having a magnetic flux density distribution at a circle which is concentric with each of said first and second pair of 2-pole ring magnets, a radius of said circle corresponding to a distance between adjacent electron beams at the main lens, a ratio of amplitude of flux density in a radial component compared to an amplitude of said flux density in a circumferential component being 0.86 to 1.38 on said circle.

8. A color cathode ray tube according to claim 7, wherein said first pair of 2-pole ring magnets and said second pair of 2-pole ring magnets have the ratio of the amplitude of said flux density in the radial component compared to the amplitude of said flux density in the circumferential component of 0.966 to 1.275 on said circle.

* * * * *